United States Patent [19]

Anderson

[11] Patent Number: 4,848,608

[45] Date of Patent: Jul. 18, 1989

[54] EXPANDABLE RACKING SYSTEM FOR TRAYS OR THE LIKE

[75] Inventor: Warren H. Anderson, Sturgis, Mich.

[73] Assignee: Grumman Aerospace Corporation, Bethpage, N.Y.

[21] Appl. No.: 107,243

[22] Filed: Oct. 9, 1987

[51] Int. Cl.[4] ..... A47G 29/00

[52] U.S. Cl. ..... 211/71; 211/126

[58] Field of Search ..... 211/71, 126, 191, 133, 211/59.2

[56] References Cited

U.S. PATENT DOCUMENTS

| | | | |
|---|---|---|---|
| 3,199,683 | 8/1965 | Graswich | 211/126 X |
| 3,771,466 | 11/1973 | Ferdinand et al. | 211/153 X |
| 3,963,125 | 6/1976 | Baggott | 211/126 |
| 4,519,511 | 5/1985 | Mendenhall | 211/191 X |
| 4,616,754 | 10/1986 | Heizzl et al. | 211/126 X |
| 4,685,574 | 8/1907 | Young et al. | 211/59.2 |

*Primary Examiner*—Reinaldo P. Machado
*Assistant Examiner*—Sarah A. Lecnok Eley
*Attorney, Agent, or Firm*—Richard G. Geib; Daniel J. Tick; Bernard S. Hoffman

[57] ABSTRACT

An expandable racking system for trays or the like having at least one upright member, at least one tray slide member, and an interlock member for slidably connecting at least one tray slide member to at least one upright member so that the alignment of at least one tray slide member relative to at least one upright member is correct and the height of at least one tray slide member relative to said at least one upright member is initially adjustable to suit user needs.

41 Claims, 11 Drawing Sheets

20
22
24
26
28
30
32
34
40
42
44
46
48
50
52
54
56
58
4
6

EXPANDABLE RACKING SYSTEM FOR TRAYS OR THE LIKE

BACKGROUND OF THE INVENTION

1. Field of the Invention

The present invention relates to an expandable racking system for trays or the like. More particularly, the present invention relates to an expandable racking system for trays or the like which has at least one upright member and at least one tray slide member.

1. Description of the Prior Art

An expandable racking system for trays or the like of the above-mentioned general type are known in the art. One such expandable racking system for trays or the like is disclosed, for example, in a steel racking system. The steel racking system possesses numerous drawbacks. For instance, the steel racking system requires adjustable fixtures to configure parts for correct alignment; the steel racking system requires skilled technicians, such as welders, to fasten parts together; the steel racking system requires paint touch-up at the weld locations: the steel racking system requires dielectric tape for installation to prevent galvanic action; the steel racking system is heavy; the steel racking system uses fasteners at floor attachment points which restrict the smooth sliding of the trays; and the steel racking system uses spacer bars that are secured with time consuming screw fasteners.

Another such expandable racking system for trays or the like is disclosed, for example, in a magnesium racking system. The magnesium racking system also possesses numerous drawbacks. For instance, the magnesium racking system requires adjustable fixtures to configure parts for correct alignment: the magnesium racking system uses riveted joints which are time consuming to produce because of the need for drilled holes: the magnesium racking system requires dielectric tape and corrosion inhibitive paint for installation to prevent galvanic action at fasteners; the magnesium racking system uses fasteners at floor attachment points which restrict the smooth sliding of the trays: and the magnesium racking system uses spacer bars that are secured with time consuming screw fasteners.

SUMMARY OF THE INVENTION

Accordingly, it is an object of the present invention to provide an expandable racking system for trays or the like which avoids the disadvantages of the prior art.

More particularly, it is an object of the present invention to provide an expandable racking system for trays or the like which does not require intricate fixturing to produce; can be secured to a surface, such as a floor, without interfering with the free sliding of the trays: uses spacer bar members that are quickly installed with push on spring steel Tinnerman nuts; uses interlock members that are sized to space the tray slide members for maximizing payload without fixturing; uses ultrasonic tools for fastening pieces; is easily cleaned; and requires no drilled holes to assemble.

In keeping with these objects, and with others which will become apparent hereinafter, one feature of the present invention resides, briefly stated, in an expandable racking system for trays or the like which has at least one upright member, and at least one tray slide member wherein means are provided for slidably connecting the at least one tray slide member to the at least one upright member.

When the expandable racking system for trays or the like is designed in accordance with the present invention, the alignment of the at least one tray slide member relative to the at least one upright member is correct and the height of the at least one tray slide member relative to the at least one upright member is initially adjustable to suit user needs.

In accordance with another feature of the present invention, the at least one upright member has a body with a central longitudinal axis, a length, and a pair of opposing sides, each side of the pair of opposing sides contain an inwardly diverging cutout disposed on either side of the central longitudinal axis along the length so that the at least one tray slide member can be positioned on each side of the pair of opposing sides of the at least one upright member.

Another feature of the present invention is that the inwardly diverging cutout contained on each side of the pair of opposing sides of the at least one upright member is the female portion of a dovetail joint.

Still another feature of the present invention is that the at least one upright member is an extrusion.

Yet another feature of the present invention is that the at least one upright member is non-metallic so that the at least one upright member is lightweight, easily cleaned, and protected from galvanic corrosion.

Still yet another feature of the present invention is that the at least one tray slide member has a length, and a substantially "L"-shaped cross section having a horizontal portion with a top surface and a bottom surface and a vertical portion with a rear surface.

Yet still another feature of the present invention is that the top surface of the horizontal portion of the at least one tray slide member has ridges disposed along the length so that sliding of the trays or the like is facilitated.

Another feature of the present invention is that the rear surface of the vertical portion of the at least one tray slide member contains an inwardly diverging cutout along the length.

Still another feature of the present invention is that the inwardly diverging cutout contained on the rear surface of the vertical portion of the at least one tray slide member is the female portion of a dovetail joint.

Yet another feature of the present invention is that the at least one tray slide member is an extrusion.

Still yet another feature of the present invention is that the at least one tray slide member is nonmetallic so that the at least one tray slide member is lightweight, easily cleaned, and protected from galvanic corrosion.

Yet still another feature of the present invention is that the connecting means include at least one interlock member having a body with an outwardly diverging protrusion disposed on the body.

Another feature of the present invention is that the body of the at least one interlock member has a narrow surface and the outwardly diverging protrusion of the at least one interlock member has a narrow surface meeting the narrow surface of the body of the at least one interlock member.

Still another feature of the present invention is that the body of the at least one interlock member is the male portion of a dovetail joint.

Yet another feature of the present invention is that the outwardly diverging protrusion of the at least one interlock member is the male portion of a dovetail joint.

Still yet another feature of the present invention is that the at least one interlock member further includes a flange disposed on the narrow surface of the body of the at least one interlock member below the outwardly diverging protrusion of the at least one interlock member and the bottom surface of the horizontal portion of the at least one tray slide member rests on the flange of the at least one interlock member.

Yet still another feature of the present invention is that the at least one interlock member is injection molded.

Another feature of the present invention is that the at least one interlock member is non-metallic so that the at least one interlock member is lightweight, easily cleaned, and protected from galvanic corrosion.

Still another feature of the present invention is that the at least one interlock member is ultrasonically welded to the at least one upright member and to the at least one tray slide member forming ultrasonic welds so that a skilled technician, such as a welder, is not required to quickly fasten the at least one upright member and the at least one tray slide member to the at least one interlock member while the need for paint touch up at the ultrasonic welds is eliminated.

Yet another feature of the present invention is that the cutout contained in each side of the pair of opposing sides of the at least one upright member slidably receives the body of the at least one interlock member and the cutout contained in the rear surface of the vertical portion of the at least one tray slide member slidably receives the outwardly diverging protrusion of the at least one interlock member, and the body of the at least one interlock member ha a predetermined length allowing the at least one interlock member to be stacked in the cutout contained in each side of the pair of opposing sides of the at least one upright member so that loading on the ultrasonic welds is reduced and the appropriate height of the at least one tray slide member is maintained as required by the user.

Yet still another feature of the present invention is that it further includes means for mounting the at least one tray slide member to a surface.

Another feature of the present invention is that the mounting means include the at least one surface anchor member having a body with a pair of opposing outwardly diverging protrusions disposed on the body.

Still another feature of the present invention is that the pair of opposing outwardly diverging protrusions have narrow surfaces that meet the body of the at least one surface anchor member.

Yet another feature of the present invention is that the pair of opposing outwardly diverging protrusions of the at least one surface anchor member are the male portions of dovetail joints.

Still yet another feature of the present invention is that the body of the at least one surface anchor member contains a longitudinally disposed throughbore.

Yet still another feature of the present invention is that the at least one surface anchor member is injection molded.

Another feature of the present invention is that the at least one surface anchor member is non-metallic so that the at least one surface anchor member is lightweight, easily cleaned, and protected from galvanic corrosion.

Still another feature of the present invention is that the cutout contained in the rear surface of the vertical portion of the at least one tray slide member slidably receives a one of the pair of opposing outwardly diverging protrusions of the at least one surface anchor member so that the horizontal portion of the at least one tray slide member is free of fasteners that would restrict smooth sliding of the trays or the like on the top surface of the horizontal portion of the at least one tray slide member.

Yet another feature of the present invention is that it further includes means for keeping the at least one upright member upright, stable, and properly spaced to suit user needs.

Still yet another feature of the present invention is that the keeping means include at least one spacer bar anchor member having a substantially "T"-shaped body with a substantially cylindrically shaped vertical portion and a horizontal portion which is a pair of opposing outwardly diverging protrusions.

Yet still another feature of the present invention is that the pair of opposing outwardly diverging protrusions of the at least one spacer bar anchor member have narrow surfaces that meet.

Another feature of the present invention is that the pair of opposing outwardly diverging protrusions of the at least one spacer bar anchor member are the male portions of dovetail joints.

Still another feature of the present invention is that the at least one spacer bar anchor member is injection molded.

Yet another feature of the present invention is that the at least one spacer bar anchor member is non-metallic so that the at least one spacer bar anchor member is lightweight, easily cleaned, and protected from galvanic corrosion.

Still yet another feature of the present invention is that the cutout contained in the rear surface of the vertical portion of the at least one tray slide member slidably receives a one of the pair of opposing outwardly diverging protrusions of the at least one spacer bar anchor member.

Yet still another feature of the present invention is that the at least one spacer bar anchor member is injection molded.

Another feature of the present invention is that the at least one spacer bar anchor member is non-metallic so that the at least one spacer bar anchor member is lightweight, easily cleaned, and protected from galvanic corrosion.

Still another feature of the present invention is that the keeping means further include at least one spacer bar member which is a flat elongated body with a pair of opposing ends containing throughbores.

Yet another feature of the present invention is that the throughbores contained in the pair of opposing ends of the flat elongated body of the at least one spacer bar member receive the substantially cylindrically shaped vertical portion of the at least one spacer bar anchor member.

Still yet another feature of the present invention is that the keeping means further include securing means removably disposed on the substantially cylindrically shaped vertical portion of the at least one spacer bar anchor member so that the at least one spacer bar member can be quickly secured to and removed from the at least one spacer bar anchor member.

Finally still a further feature of the present invention is that the securing means include at least one spring steel Tinnerman nut.

The novel features which are considered characteristic for the invention are set forth in particular in the appended claims. The invention itself, however, both as to its construction and its method of operation, together with additional objects and advantages thereof, will be best understood from the following description of the specific embodiment when read in connection with the accompanying drawings.

BRIEF OF THE DRAWING

FIG. 1 is a perspective view of a typical section of the expandable racking system for trays or the like of the present secured to a surface and receiving a tray or the like;

DETAILED DESCRIPTION OF THE PREFERRED EMBODIMENT

Figure 1:
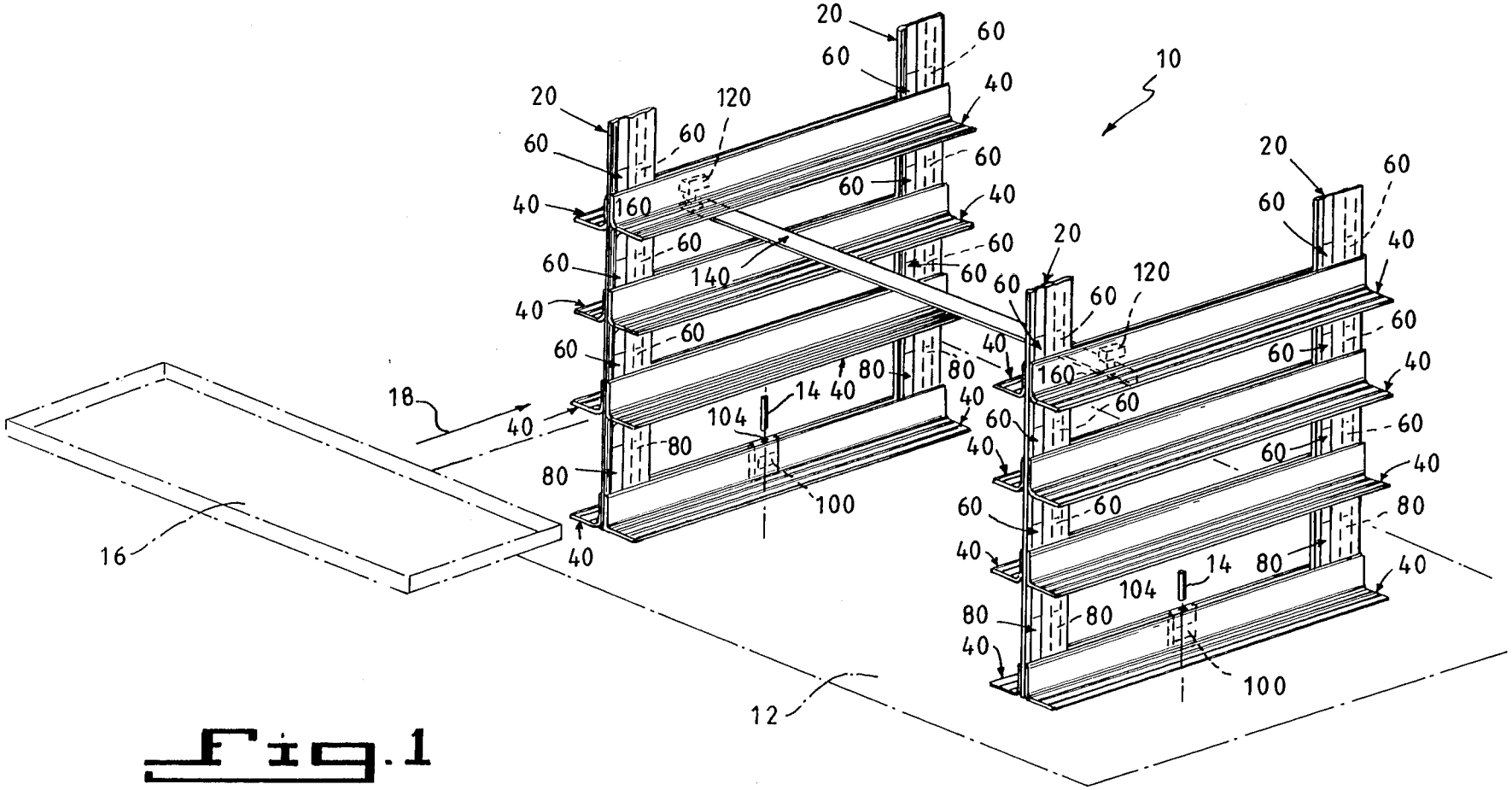
Figure 2:
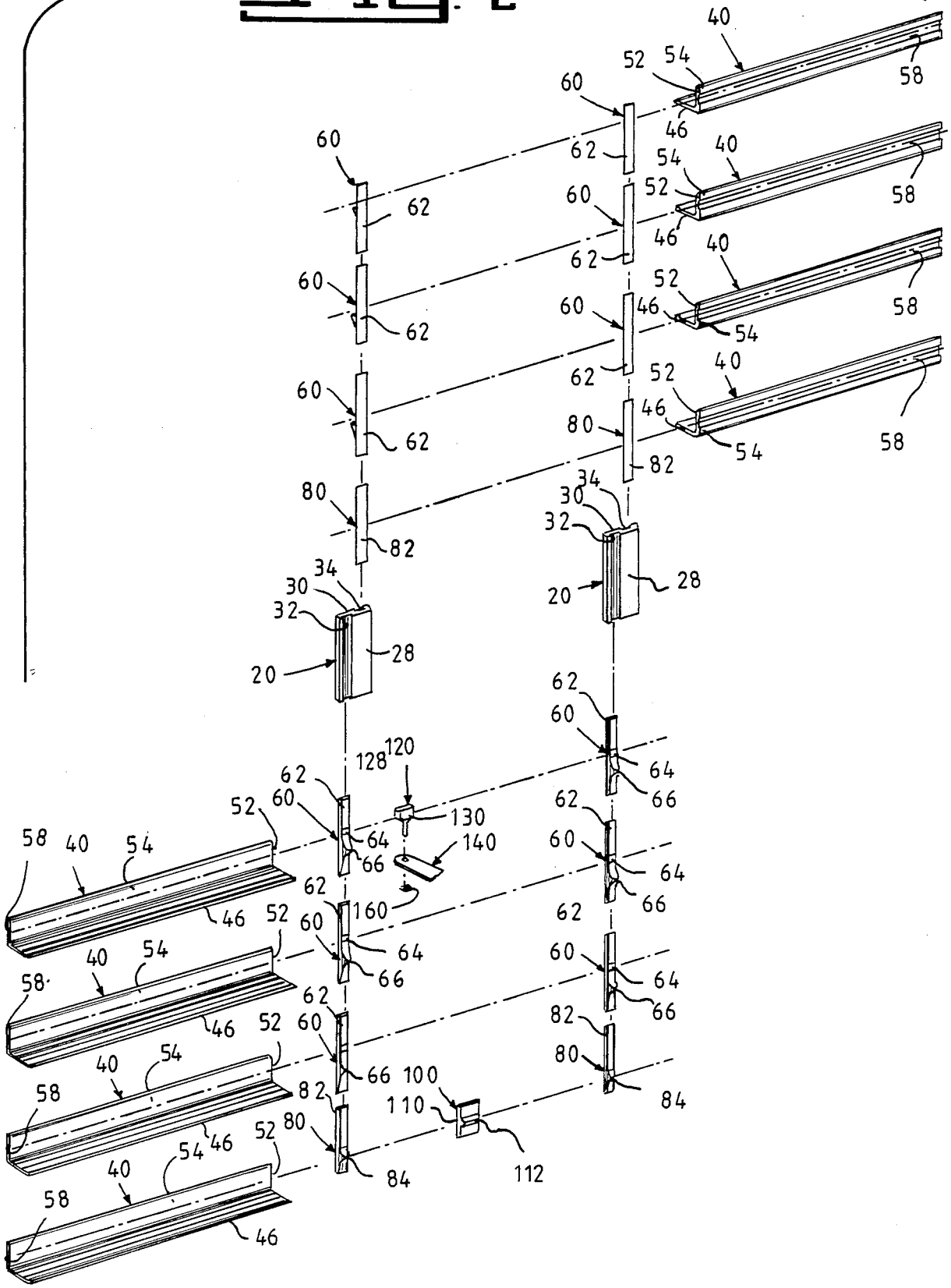
FIG. 2 is an exploded perspective view of the present invention shown in FIG. 1.

Referring now to FIGS. 1 and 2, a typical section of the expandable racking system for trays or the like of the present invention is shown generally at 10 mounted to a surface 12 (shown in phantom) by fasteners 14 and receiving a tray 16 or the like (shown in phantom) in the direction of arrow 18. The surface 12 can be a stationary floor, a movable floor, a van body floor, or the like. The fasteners 14 can be screws, rivets, or the like. The racking system 10 of the present invention includes at least upright members 20, tray slide members 40, upper interlock members 60, lower interlock members 80, surface anchor members 100, spacer bar anchor members 120, spacer bat members 140, and spring steel Tinnerman nuts 160. By combining the typical sections shown in FIG. 1, the expandable racking system for trays or the like 10 can be fashioned for user needs.

Figures 3, 4, 5, 6:
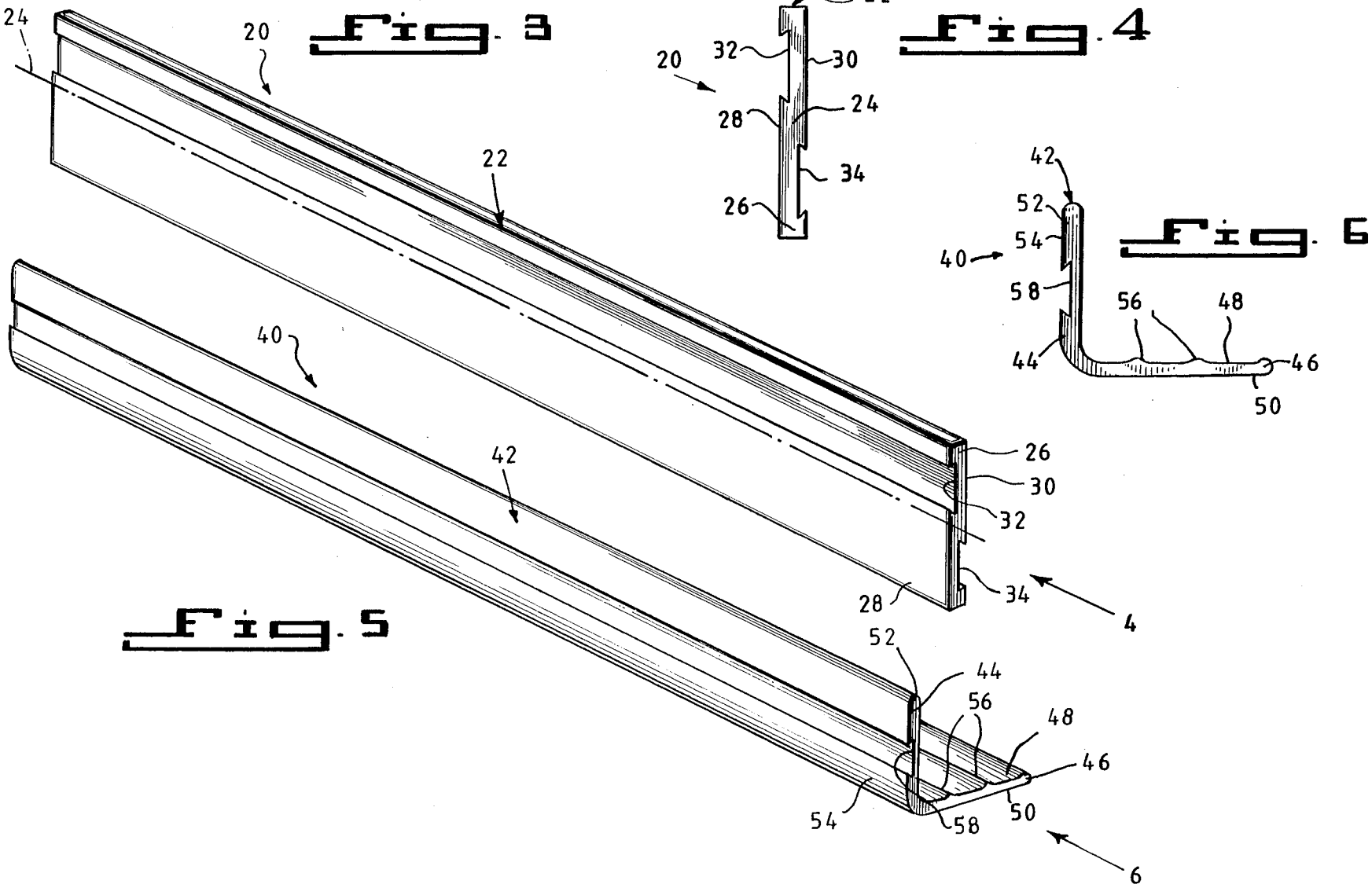
FIG. 3 is view of the upright member of the present invention shown in FIGS. 1 and 2.
FIG. 4 is a plan view of the upright member of the present invention taken in the direction of arrow 4 shown in FIG. 3.
FIG. 5 is a perspective view of the tray slide member of the present invention shown in FIGS. 1 and 2.
FIG. 6 is plan view of the tray slide member of the present invention taken in the direction of arrow 6 shown in FIG. 5.

A typical upright member 20 of the racking system 10 is shown generally in FIGS. 3 and 4. The upright member 20 has an elongated body 22 (of any predetermined length) with a centrally disposed longitudinal axis 24, and a cross section 26 which has a pair of opposing substantially parallel sides 28 and 30. Each of the opposing sides 28 and 30 contain an inwardly diverging cutout 32 and 34, respectively, disposed on either side of the central longitudinal axis 24. The cutouts 32 and 34 form the female portions of dovetail joints or the like. The upright member 20 is preferably an extrusion, but may be produced by other means. The upright member 20 is preferably non-metallic so that galvanic corrosion is prevented, it is lightweight, and it is easily cleaned. However, the upright member 20 may be produced of other materials.

A typical tray slide member 40 of the racking system 10 is shown generally in FIGS. 5 and 6. The tray slide member 40 has an elongated body 42 (of any predetermined length), and a substantially "L"-shaped cross section 44 which has a horizontal portion 46 and a vertical portion 52. The horizontal portion 46 has a top surface 48 and a bottom surface 50 while the vertical portion 52 has a rear surface 54. The top surface 48 of the horizontal portion 46 of the tray slide member 40 has ridges 56 disposed thereon to facilitate sliding of the tray 16 or the like. The rear surface 54 of the vertical portion 52 of the tray slide member 40 contains an inwardly diverging cutout 58. The cutout 58 forms the female portion of a dovetail joint or the like. The tray slide member 40 is preferably an extrusion, but may be produced by other means. The tray slide member 40 is preferably non-metallic so that galvanic corrosion is prevented, it is lightweight, and it is easily cleaned. However, the tray slide member 40 may be produced of other materials.

Figure 9:
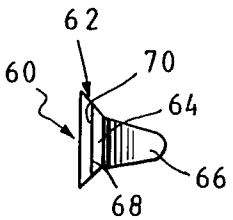
FIG. 9 is a plan view of the upper interlock member of the present invention taken in the direction of arrow 9 shown in FIG. 7.
Figure 8:
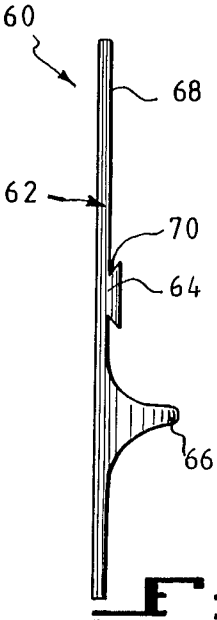
FIG. 8 is a plan view of the upper interlock member of the present invention taken in the direction of arrow 8 shown in FIG. 7.
Figure 7:
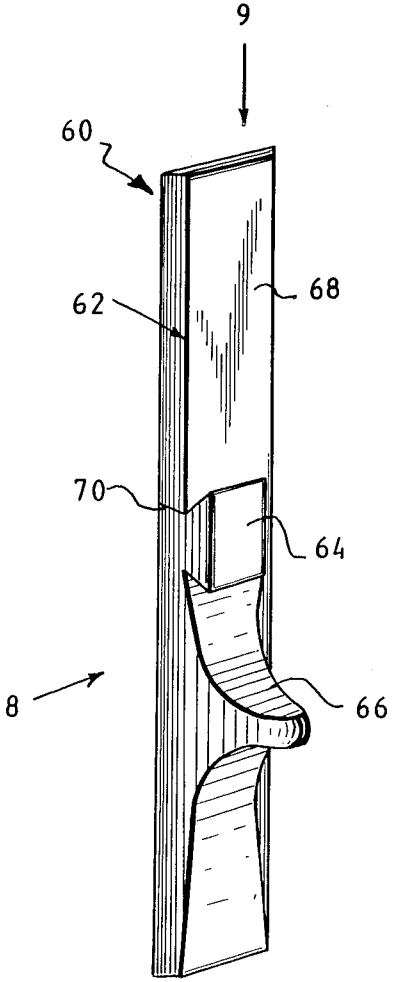
FIG. 7 is a perspective view of the upper interlock member of the present invention shown in FIGS. 1 and 2.
Figures 13, 14, 15, 16, 17, 18, 19, 20:
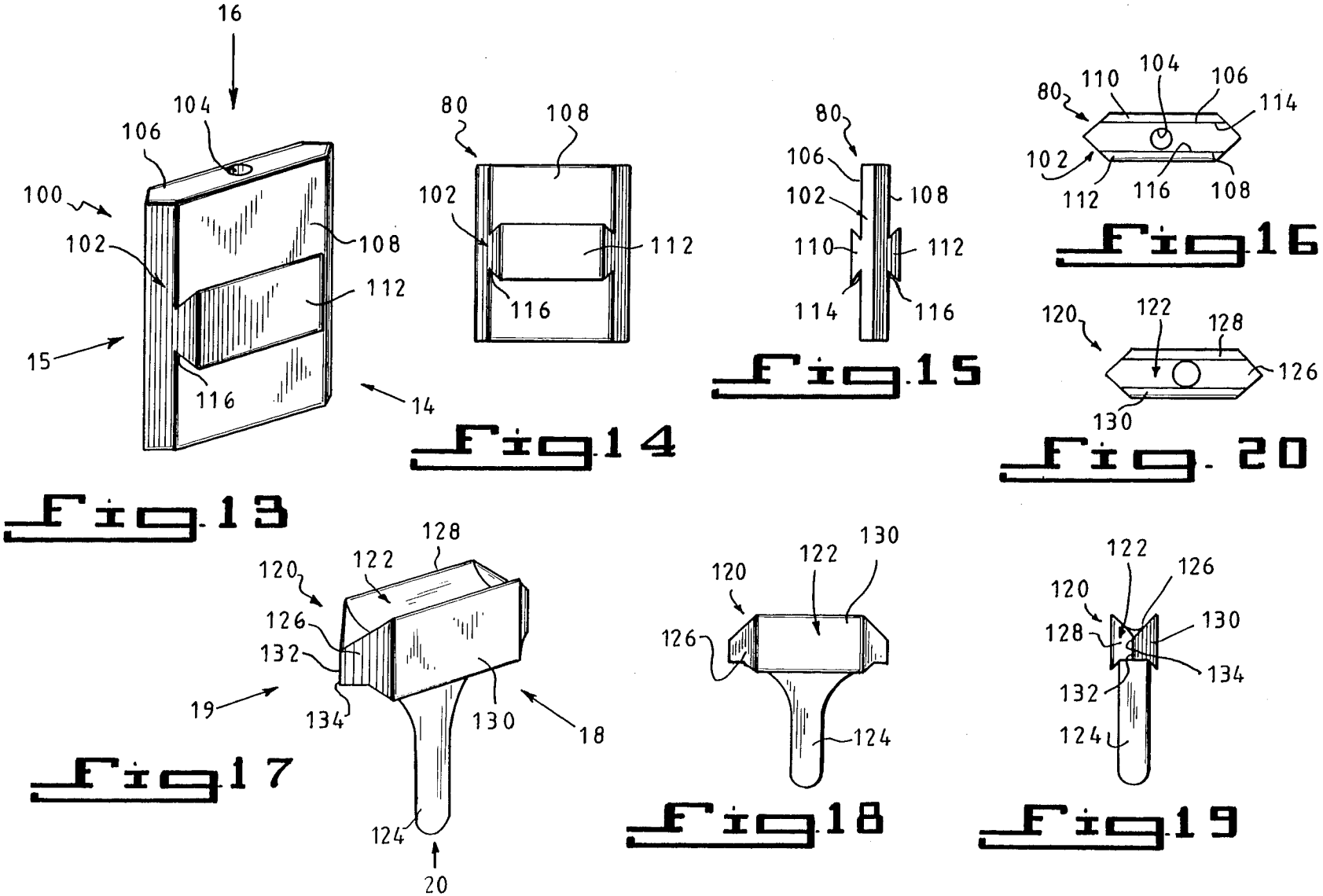
FIG. 13 is a perspective view of the surface anchor member of the present invention shown in FIGS. 1 and 2.
FIG. 14 is a plan view of the surface anchor member of the present invention taken in the direction of arrow 14 shown in FIG. 13.
FIG. 15 is a plan view of the surface anchor member of the present invention taken in the direction of arrow 15 shown in FIG. 13.
FIG. 16 is a plan view of the surface anchor member of the present invention taken in the direction of arrow 16 shown in FIG. 13.
FIG. 17 is a perspective view of the spacer bar anchor member of the present invention shown in FIGS. 1 and 2.
FIG. 18 is a plan view of the spacer bar anchor member of the present invention taken in the direction of arrow 18 shown in FIG. 17.
FIG. 19 is a plan view of the spacer bar anchor member of the present invention taken in the direction of arrow 19 shown in FIG. 17.
FIG. 20 is a plan view of the spacer bar anchor member of the present invention taken in the direction of arrow 20 shown in FIG. 17.

A typical upper interlock member 60 of the racking system 10 is shown generally in FIGS. 7 to 9, inclusive. The upper interlock member 60 has a body 62 with an outwardly diverging protrusion 64 and a flange 66 disposed on the body 62. The body 62 has a narrow surface 68 and the outwardly diverging protrusion 64 has a narrow surface 70 which meets the narrow surface 68 of the body 62. The flange 66 is disposed on the narrow surface 68 of the body 62 below the outwardly diverging protrusion 64. The body 62 and the outwardly diverging protrusion 64 form the male portions of dovetail joints or the like. The upper interlock member 60 is preferably injection molded, but may be produced by other means The upper interlock member 60 is preferably non-metallic so that galvanic corrosion is prevented, it is lightweight, and it is easily cleaned. However, the upper interlock member 60 may be produced of other materials.

Figure 12:
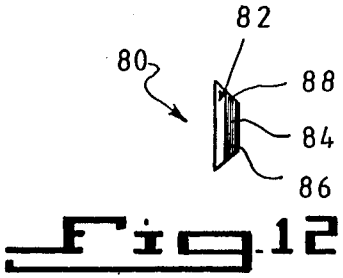
FIG. 12 is a plan view of the lower interlock member of the present invention taken in the direction of arrow 12 shown in FIG. 10.
Figure 11:
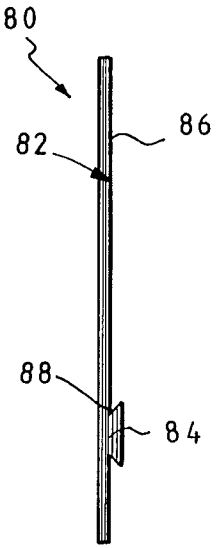
FIG. 11 is a plan view of the lower interlock member of the present invention taken in the direction of arrow 11 shown in FIG. 10.
Figure 10:
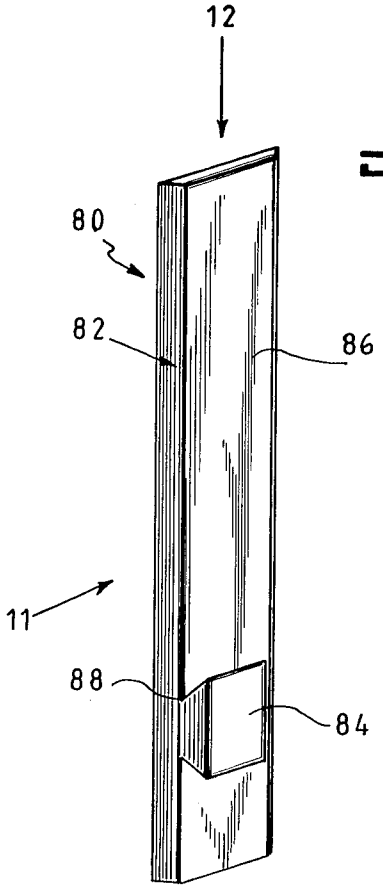
FIG. 10 is a view of the lower interlock member of the present invention shown in FIGS. 1 and 2.

A typical lower interlock member 80 of the racking system 10 is shown generally in FIGS. 10 to 12, inclusive. The lower interlock member 80 has a body 82 with an outwardly diverging protrusion 84. The body 82 and the outwardly diverging protrusion 84 may be considered similar to the body 62 and the outwardly diverging protrusion 64, respectively, of the upper interlock member 60. The body 82 has a narrow surface 86 and the outwardly diverging protrusion 84 has a narrow surface 88 which meets the narrow surface 86 of the body 82. The body 82 and the outwardly diverging protrusion 84 form the male portions of dovetail joints or the like. The lower interlock member 80 is preferably injection molded, but may be produced by other means. The lower interlock member 80 is preferably non-metallic so that galvanic corrosion is prevented, it is lightweight and it is easily cleaned. However, the lower interlock member 80 may be produced of other materials.

A typical surface anchor member 100 of the racking system 10 is shown generally in FIGS. 13 to 16, inclusive. The surface anchor member 100 has an elongated body 102 containing a longitudinally disposed throughbore 104 and a pair of opposing substantially parallel sides 106 and 108 which have a pair of opposing outwardly diverging protrusions 110 and 112 disposed, respectively, thereon. The outwardly diverging protrusions 110 and 112 have narrow surfaces 114 and 116, respectively, which meet the pair of sides 106 and 108, respectively, of the body 102. The outwardly diverging protrusions 110 and 112 form the male portions of dovetail joints or the like. The surface anchor member 100 is preferably injection molded, but may be produced by other means. The surface anchor member 100 is preferably non-metallic so that galvanic corrosion is prevented, it is lightweight, and it is easily cleaned. However, the surface anchor member 100 may be produced of other materials.

A typical spacer bar anchor member 120 of the racking system 10 is shown generally in FIGS. 17 to 20 inclusive. The spacer bar anchor member 120 has a substantially "T"-shaped body 122 with a cylindrically shaped vertical portion 124 and a horizontal portion 126 which is substantially a pair of opposing substantially parallel outwardly diverging protrusions 128 and 130. The opposing substantially parallel outwardly diverging protrusions 128 and 130 have narrow surfaces 132 and 134, respectively, that meet. The opposing substantially parallel outwardly diverging protrusions 128 and 130 form the male portions of dovetail joints or the like. The spacer bar anchor member 120 is preferably injection molded, but may be produced by other means. The spacer bar anchor member is preferably non-metallic so that galvanic corrosion is prevented, it is lightweight, and it is easily cleaned. However, the spacer bar anchor member 120 may be produced of other materials.

Figure 21:
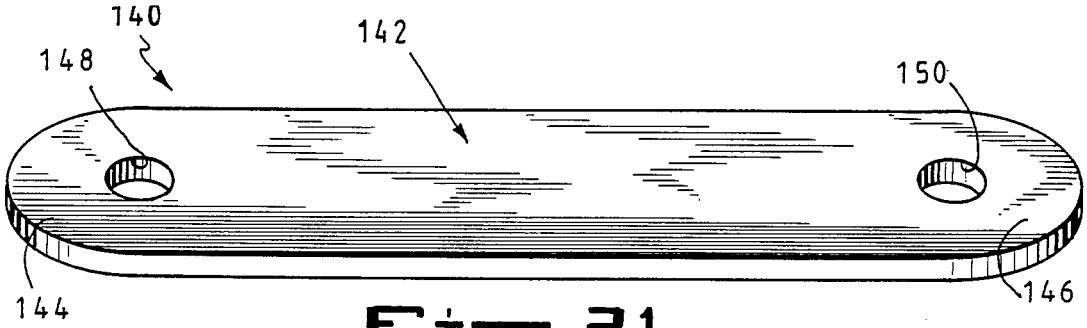
FIG. 21 is a perspective view of the spacer bar member of the present invention shown in FIGS. 1 and 2.

The typical spacer bar member 140 of the racking system 10 is shown generally in FIG. 21. The spacer bar member 140 is a flat elongated body 142 with a pair of ends 144 and 146 containing a pair of throughbores 148 and 150, respectively. The spacer bar member 140 is preferably injection molded, but may be produced by other means. The spacer bar member 140 is preferably non-metallic so that galvanic corrosion is prevented, it is lightweight, and it is easily cleaned. However, the spacer bar member 140 may be produced of other materials.

Figure 22:
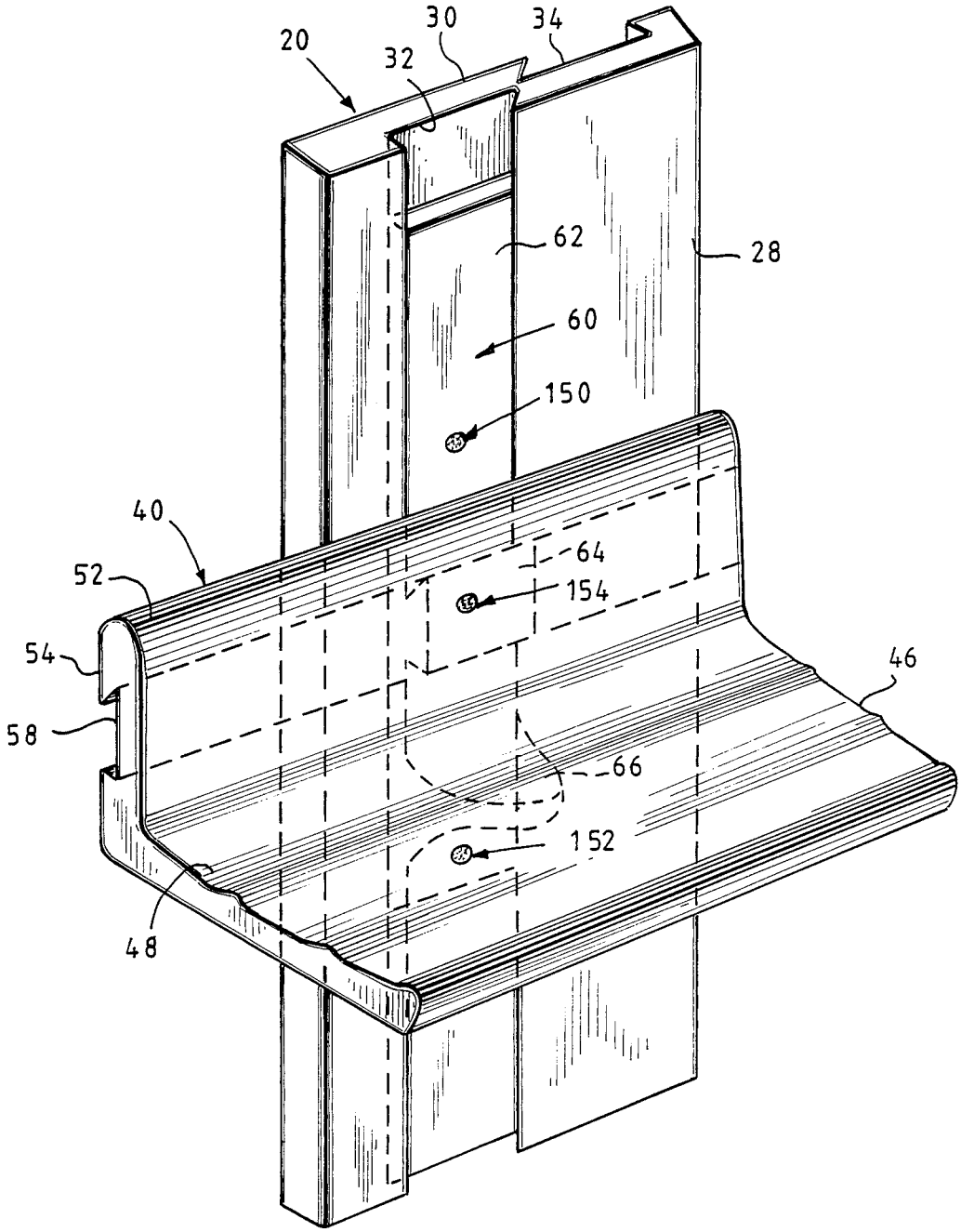
FIG. 22 is a perspective view of an ultrasonically welded joint of the present invention shown in FIGS. 1 and 2.

As shown in FIGS. 1, 2, and 22, the cutouts 32 and 34 contained in the opposing sides 28 and 30, respectively, of the upright members 20 slidably receive the body 62 of the upper interlock members 60 and the body 82 of the lower interlock members 80 to form dovetail joints or the like. The cutout 58 contained in the rear surface 54 of the vertical portion 52 of the tray slide members 40 slidably receives the outwardly diverging protrusion 64 of the upper interlock members 60 and the outwardly diverging protrusion 84 of the lower interlock members 80 to form dovetail joints or the like. The horizontal portion 46 of the tray slide members 40 rests on the flange 66 of the upper interlock member 60 while the horizontal portion 46 of the tray slide members 40 of the lower interlock members 80 rests on the surface 12 to which the racking system 10 is mounted. The upper interlock members 60 and the lower interlock members 80 are ultrasonically welded to the upright members 20 and to the tray slide members 40 forming ultrasonic welds 150, 152, and 154, respectively. The ultrasonic welds 150, 152, and 154 do not require touch up paint. Since a skilled technician, such as a welder, is not required, the ultrasonic welds 150, 152, and 154 are made quickly.

By using dovetail joints or the like in the racking system 10, as shown in FIGS. 1, 2, and 22, less structurally sensitive attachments are required while proper alignment of parts is assured. The body 62 and the body 82 of the upper interlock members 60 and the lower interlock members 80, respectively, have a predetermined length which allows the upper interlock members 60 and the lower interlock members 80 to be stacked touching one another in the cutouts 32 and 34 contained in the opposing sides 28 and 30, respectively, of the upright members 20. This stacking reduces the loading on the ultrasonic welds 150, 152, and 154 and maintains the appropriate height of the tray slide members 40, as required by the user. The cutout 58 contained in the rear surface 54 of the vertical portion 52 of the tray slide members 40 slidably receives the outwardly diverging protrusions 110 and 112 of the surface anchor members 100. By fastening the racking system 10 with the fasteners 14 to the surface 12 via the throughbore 104 of the surface anchor members 100, the horizontal portion 46 of the tray slide members 40 is free of fasteners that restrict smooth sliding of the tray 16 or the like on the top surface 48 of the horizontal portion 46 of the tray slide members 40. The cutout 58 contained in the rear surface 54 of the vertical portion 52 of the tray slide members 40 slidably receives the outwardly diverging protrusions 128 and 130 of the spacer bar anchor members 120. The pair of throughbores 148 and 150 contained in the pair of ends 144 and 146, respectively, of the flat elongated body 142 of the spacer bar members 140 receives the cylindrically shaped vertical portion 124 of the spacer bar anchor members 120.

Figure 23:
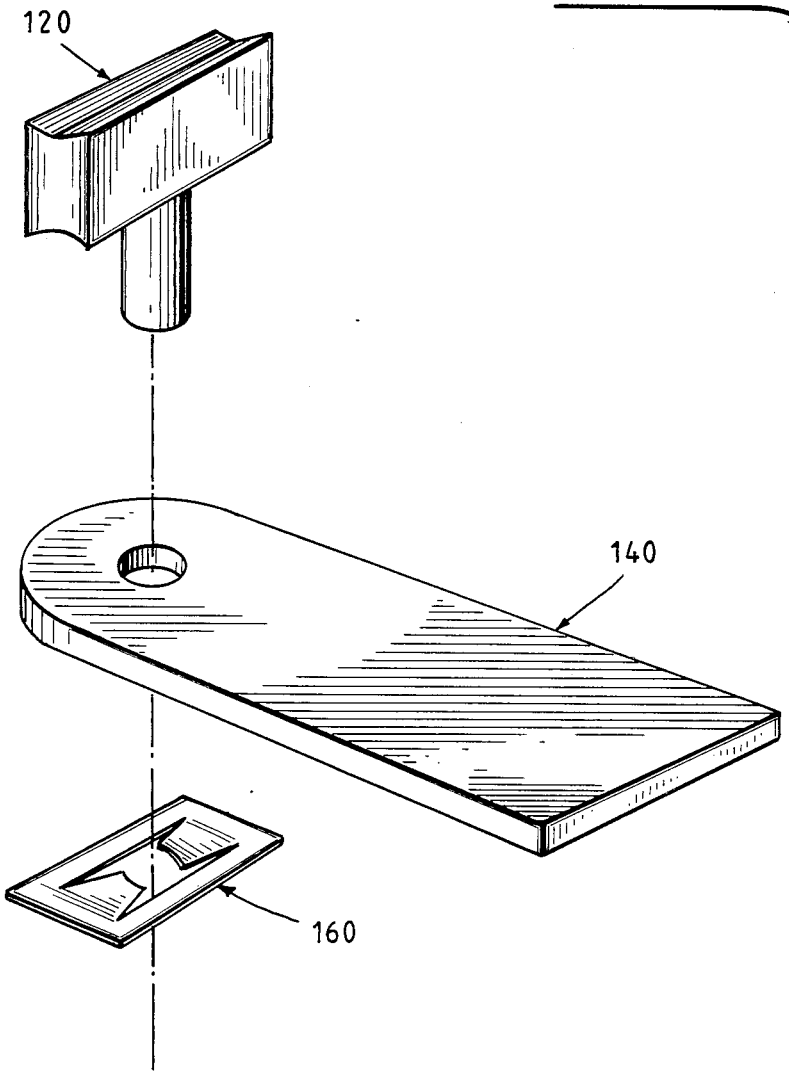
FIG. 23 is an exploded perspective view of the keeping and securing means of the present invention shown in FIGS. 1 and 2.

As shown in FIG. 23, the push on spring steel Tinnerman nut 160 is removably mounted to the cylindrically shaped vertical portion 124 of the spacer bar anchor members 120 which allows the spacer bar members 140 to be quickly secured to and removed from the spacer bar anchor members 120.

By the use of the spacer bar anchor members 120, the spacer bar members 140, and the spring steel Tinnerman nuts 160, in the racking system 10 as shown in FIGS. 1 and 2, the typical sections of the racking system 10 are held together, kept upright and stable, and properly spaced to suit user needs.

It will be understood that each of the elements described above, or two or more together, may also find a useful application in other types of constructions differing from the type described above.

While the invention has been illustrated and described as embodied in an expanded racking system for trays or the like, it is not intended to be limited to the details above, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. A non-metallic expandable shelfless racking system for trays or the like, comprising:

(a) at least one upright member being non-metallic so that said at least one upright member is lightweight, easily cleaned, and protected from galvanic corrosion without the need for dielectric tape and corrosion inhibitive paint;

(b) at least one tray slide member for slidably and removably supporting the trays and being non-metallic so that said at least one tray slide member is lightweight, easily cleaned, and protected from galvanic corrosion without the need for dielectric tape and corrosion inhibitive paint, said at least one tray slide member having ridges disposed along length so that sliding of the trays is facilitated; and (c) means for connecting said at least one tray slide member to said at least one upright member without the need for drilling holes for rivets or fasteners so that assembly is expedited, said connecting means being non-metallic so that said connecting means is lightweight, easily cleaned, and protected from galvanic corrosion without the need for dielectric tape and corrosion inhibitive paint, said connecting means assuring that the alignment of said at least one tray slide member relative to said at least one upright member is correct without the need for adjustable fixtures, said connecting means being presized to correctly space said at least one tray slide member so that fixtures are not needed, said connecting means assuring that height of said at least one tray slide member relative to said at least one upright member is correct to maximize payload to suit user needs, said connecting means being ultrasonically welded to said at least one upright member and to said at least one tray slide member forming ultrasonic welds so that a skilled technician, such as a welder, is not required to quickly fasten said at least one upright member and said at least one tray slide member to said connecting means while the need for paint touch up at the ultrasonic wells is eliminate, said connecting means having a predetermined length allowing said connecting means to be stacked in sides of said at least one upright member so that loading on the ultrasonic welds is reduced and the appropriate height of said at least one tray slide member is maintained as required by the user.

2. A system as defined in claim 1, wherein said at least one upright member has a body with a central longitudinal axis, a length, and a pair of opposing sides, each side of said pair of opposing sides containing an inwardly diverging cutout disposed on either side of said central longitudinal axis along said length so that said at least one tray slide member can be positioned on said each side of said pair of opposing sides of said at least one upright member.

3. A system as defined in claim 2, wherein said inwardly diverging cutout contained on said each side of said pair of opposing sides of said at least one upright member is the female portion of a dovetail joint.

4. A system as defined in claim 3, wherein said at least one upright member is an extrusion.

5. A system as defined in claim 4, wherein said at least one upright member is non-metallic so that said at least one upright member is lightweight, easily cleaned, and protected from galvanic corrosion.

6. A system as defined in claim 5, wherein said at least one tray slide member has a length, and a substantially "L"-shaped cross section having a horizontal portion with a top surface and a bottom surface and a vertical portion with a rear surface.

7. A system as defined in claim 6, wherein said top surface of said horizontal portion of said at least one tray slide member has ridges disposed along said length so that sliding of the trays or the like is facilitated.

8. A system as defined in claim 7, wherein said rear surface of said vertical portion of said at least one tray slide member contains an inwardly diverging cutout along said length.

9. A system as defined in claim 8, wherein said inwardly diverging cutout contained on said rear surface of said vertical portion of said at least one tray slide member is the female portion of a dovetail joint.

10. A system as defined in claim 9, wherein said at least one tray slide member is an extrusion.

11. A system as defined in claim 10, wherein said at least one tray slide member is non-metallic so that said at least one tray slide member is lightweight, easily cleaned, and protected from galvanic corrosion.

12. A system as defined in claim 11, wherein said connecting means include at least one interlock member having a body with an outwardly diverging protrusion disposed on said body.

13. A system as defined in claim 12, wherein said body of said at least one interlock member has a narrow surface and said outwardly diverging protrusion of said at least one interlock member has a narrow surface meeting said narrow surface of said body of said at least one interlock member.

14. A system as defined in claim 13, wherein said body of said at least one interlock member is the male portion of a dovetail joint.

15. A system as defined in claim 14, wherein said outwardly diverging protrusion of said at least one interlock member is the male portion of a dovetail joint.

16. A system as defined in claim 15, wherein said at least one interlock member further includes a flange disposed on said narrow surface of said body of said at least one interlock member below said outwardly diverging protrusion of said at least one interlock member, said bottom surface of said horizontal portion of said at least one tray slide member resting on said flange of said at least one interlock member.

17. A system as defined in claim 15 or 16, wherein said at least one interlock member is injection molded.

18. A system as defined in claim 17, wherein said at least one interlock member is non-metallic so that said at least one interlock member is lightweight, easily cleaned, and protected from galvanic corrosion.

19. A system as defined in claim 18, wherein said at least one interlock member is ultrasonically welded to said at least one upright member and to said at leas one tray slide member forming ultrasonic welds so that a skilled technician, such as a welder, is not required to quickly fasten said at least one upright member and said at least one tray slide member to said at least one interlock member while the need for paint touch up at the ultrasonic welds is eliminated.

20. A system as defined in claim 19, wherein said cutout contained in said each side of said pair of opposing sides of said at least one upright member slidably receives said body of said at least one interlock member and said cutout contained in said rear surface of said vertical portion of said at least one tray slide member slidably receiving said outwardly diverging protrusion of said at least one interlock member, said body of said at least one interlock member having a predetermined length allowing said at least one interlock member to be stacked in said cutout contained in said each side of said pair of opposing sides of said at least one upright member so that loading on said ultrasonic welds is reduced and appropriate height of said at least one tray slide member is maintained as required by user.

21. A system as defined in claim 20: further comprising means for mounting said at least one tray slide member to a surface.

22. A system as defined in claim 21, wherein said mounting means include at least one surface anchor member having a body with a pair of opposing outwardly diverging protrusions disposed on said body.

23. A system as defined in claim 22, wherein said pair of opposing outwardly diverging protrusions have narrow surfaces that meet said body of said at least one surface anchor member.

24. A system as defined in claim 23, wherein said pair of opposing outwardly diverging protrusions of said at least one surface anchor member are the male portions of dovetail joints.

25. A system as defined in claim 24, wherein said body of said at least one surface anchor member contains a longitudinally disposed throughbore.

26. A system as defined in claim 25, wherein said at least one surface anchor member is injection molded.

27. A system as defined in claim 26, wherein said at least one surface anchor member is non-metallic so that said at least one surface anchor member is lightweight, easily cleaned, and protected from galvanic corrosion.

28. A system as defined in claim 27, wherein said cutout contained in said rear surface of said vertical portion of said at least one tray slide member slidably receives a one of said pair of opposing outwardly diverging protrusions of said at least one surface anchor member so that said horizontal portion of said at least one tray slide member is free of fasteners that restrict smooth sliding of the trays or the like on said top surface of said horizontal portion of said at least one tray slide member.

29. A system as defined in claim 28; further comprising means for keeping said upright member upright, stable, and properly spaced to suit user needs.

30. A system as defined in claim 29, wherein said keeping means include at least one spacer bar anchor member having a substantially "T"-shaped body with a substantially cylindrically shaped vertical portion and a horizontal portion being a pair of opposing outwardly diverging protrusions.

31. A system as defined in claim 30, wherein said pair of opposing outwardly diverging protrusions of said at least one spacer bar anchor member have narrow surfaces that meet.

32. A system as defined in claim 31, wherein said pair of opposing outwardly diverging protrusions of said at least one spacer bar anchor member are the male portions of dovetail joints.

33. A system as defined in claim 32, wherein said at least one spacer bar anchor member is injection molded.

34. A system as defined in claim 33, wherein said at least one spacer bar anchor member is non-metallic so that said at least one spacer bar anchor member is lightweight, easily cleaned, and protected from galvanic corrosion.

35. A system as defined in claim 34, wherein said cutout contained in said rear surface of said vertical portion of said at least one tray slide member slidably receives a one of said pair of opposing outwardly diverging protrusions of said at least one spacer bar anchor member.

36. A system as defined in claim 35, wherein said at least one spacer bar anchor member is injection molded.

37. A system as defined in claim 36, wherein said at least one spacer bar anchor member is non-metallic so that said at least one spacer bar anchor member is lightweight, easily cleaned, and protected from galvanic corrosion.

38. A system as defined in claim 37, wherein said keeping means further include at least one spacer bar member being a flat elongated body with a pair of opposing ends containing throughbores.

39. A system as defined in claim 38, wherein said throughbores contained in said pair of ends of said flat elongated body of said at least one spacer bar anchor member receive said substantially cylindrically shaped vertical portion of said at least one spacer bar anchor member.

40. A system as defined in claim 39, wherein said keeping means further include securing means removably disposed on said substantially cylindrically shaped vertical portion of said at least one spacer bar anchor member so that said at least one spacer bar member can be quickly secured to and removed from said at least one spacer bar anchor member.

41. A system as defined in claim 40, wherein said securing means include at least one spring steel Tinnerman nut.

* * * * *

UNITED STATES PATENT AND TRADEMARK OFFICE

CERTIFICATE OF CORRECTION

PATENT NO. : 4,848,608

DATED : July 18, 1989

INVENTOR(S) : WARREN H. ANDERSON

It is certified that error appears in the above-identified patent and that said Letters Patent is hereby corrected as shown below:

Title page, line [73], "Aerospace" should be -- Olson --
Col. 1, line 24, the colon should be a semi colon
line 56, the colon should be a semi colon Col. 3, line 33, "ha" should be -- has --

Col. 5, line 11, "present" should be -- present invention --
line 15, "is" should be -- is a perspective --
line 34, "a" should be -- a perspective --

Col. 6, line 22, "bat" should be -- bar --

Col 10, line 2 (claim 1) "wells is eliminate" should be -- welds is eliminated --

Col. 11, line 15 (claim 19) "leas" should be -- least --

Signed and Sealed this

Eighteenth Day of February, 1992

*Attest:*

HARRY F. MANBECK, JR.

*Attesting Officer*

*Commissioner of Patents and Trademarks*